US009016379B2

(12) United States Patent
Xu

(10) Patent No.: US 9,016,379 B2
(45) Date of Patent: Apr. 28, 2015

(54) METHOD OF FRACING A WELLBORE

(71) Applicant: YingQing Xu, Tomball, TX (US)

(72) Inventor: YingQing Xu, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 90 days.

(21) Appl. No.: 13/871,393

(22) Filed: Apr. 26, 2013

(65) Prior Publication Data

US 2013/0233561 A1 Sep. 12, 2013

Related U.S. Application Data

(62) Division of application No. 13/047,388, filed on Mar. 14, 2011, now Pat. No. 8,579,036.

(51) Int. Cl.

| | |
|---|---|
| ***E21B 34/06*** | (2006.01) |
| ***E21B 43/26*** | (2006.01) |
| ***E21B 34/14*** | (2006.01) |

(52) U.S. Cl.

CPC ..... *E21B 43/26* (2013.01); *E21B 34/063* (2013.01); *E21B 34/14* (2013.01)

(58) Field of Classification Search

CPC ..... E21B 43/26; E21B 34/14; E21B 34/063

USPC ..... 166/376, 373, 318, 308, 243, 317, 381, 166/332.3, 325; 251/175, 315.01, 315.03, 251/317, 360

See application file for complete search history.

(56) References Cited

U.S. PATENT DOCUMENTS

| | | | | |
|---|---|---|---|---|
| 3,865,188 | A | 2/1975 | Doggett et al. | |
| 5,505,260 | A | 4/1996 | Andersen et al. | |
| 7,552,777 | B2 | 6/2009 | Murray et al. | |
| 2004/0163820 | A1 | 8/2004 | Bishop et al. | |
| 2008/0164026 | A1 | 7/2008 | Johnson | |
| 2008/0302538 | A1 | 12/2008 | Hofman | |
| 2009/0084553 | A1 * | 4/2009 | Rytlewski et al. | 166/305.1 |

OTHER PUBLICATIONS

Abdoulaye Seyni, Nadine Le Bolay, Sonia Molina-Boisseau, "On the interest of using degradable fillers in co-ground composite materials", Powder Technology 190, (2009) pp. 176-184.

CH. Christoglou, N. Voudouris, G.N. Angelopoulos, M. Pant, W. Dahl, "Deposition of Aluminum on Magnesium by a CVD Process", Surface and Coatings Technology 184 (2004) 149-155.

Constantin Vahlas, Bri Gitte Caussat, Philippe Serp, George N. Angelopoulos, "Principles and Applications of CVD Powder Technology", Materials Sciene and Engineering R 53 (2006) 1-72.

Yi Feng, Hailong Yuan, "Electroless Plating of Carbon Nanotubes with Silver" Journal fo Materials Science, 39, (2004) pp. 3241-3243.

(Continued)

*Primary Examiner* — Yong-Suk ( Philip) Ro

(74) *Attorney, Agent, or Firm* — Cantor Colburn LLP

(57) ABSTRACT

A method of fracing a wellbore includes sealing a tubular within a wellbore at two locations and defining an annular space between the tubular, the wellbore and two seals. The method further includes opening at least two ports providing fluidic communication between an inside of the tubular and the annular space, flowing fluid from inside the tubular to the annular space through a first of the at least two ports while flowing fluid from the annular space to inside of the tubular through a second of the at least two ports, closing the second of the at least two ports, and pressuring the annular space through the first of the at least two ports.

11 Claims, 3 Drawing Sheets

(56) References Cited

OTHER PUBLICATIONS

E. Flahaut et al., "Carbon Nanotube-Metal-Oxide Nanocomposites: Microstructure, Electrical Conductivity and Mechanical Properties" Acta amter. 48 (2000) 3803-3812.

C.S. Goh, J. Wei, L C Lee, and M. Gupta, "Development of novel carbon nanotube reinforced magnesium nanocomposites using the powder metallurgy technique", Nanottechnology 17 (2006) 7-12.

Guan Ling Song, Andrej Atrens "Corrosion Mechanisms of Magnesium Alloys", Advanced Engineering Materials 1999, 1, No. 1, pp. 11-33.

H. Hermawan, H. Alamdari, D. Mantovani and Dominique Dube, "Iron-manganese: new class of metallic degradable biomaterials prepared by powder metallurgy", Powder Metallurgy, vol. 51, No. 1, (2008), pp. 38-45.

J. Dutta Majumdar, B. Ramesh Chandra, B.L. Mordike, R. Galun, I. Manna, "Laser Surface Engineering of a Magnesium Alloy with Al + Al2O3", Surface and Cotaings Technology 179 (2004) 297-305.

J.E. Gray, B. Luan, "Protective Coatings on Magnesuim and Its Alloys—A Critical Review", Journal of Alloys and Compounds 336 (2002) 88-113.

Toru Kuzumaki, Osamu Ujiie, Hideki Ichinose, and Kunio Ito, "Mechanical Characteristics and Preparation of Carbon Nanotube Fiber-Reinforced Ti Composite", Advanced Engineering Materials, 2000, 2, No. 7.

Xiaowu Nie, Patents of Methods to Prepare Intermetallic Matrix Composites: A Review, Recent Patents on Materials Science 2008, 1, 232-240, Department of Scientific Research, Hunan Railway College of Science and Technology, Zhuzhou, P.R. China.

Notification of Transmittal of the International Search Report and the Written Opinion of the International Searching Authority; PCT/US2012/025247; Korean Intellectual Property Office; Mailed Oct. 10, 2012; 10 pages.

Shimizu et al., "Multi-walled carbon nanotube-reinforced magnesium alloy composites", Scripta Materialia, vol. 58, Issue 4, pp. 267-270.

Jing Sun, Lian Gao, Wei Li, "Colloidal Processing fo Carbon Nanotube/Alumina Composites" Chem. Mater. 2002, 14, 5169-5172.

Xiaotong Wang et al., "Contact-Damage-Resistant Ceramic/Single-Wall Carbon Nanotubes and Ceramic/Graphite Composites" Nature Materials, vol. 3, Aug. 2004, pp. 539-544.

Y. Zhang and Hongjie Dai, "Formation of metal nanowires on suspended single-walled carbon nanotubes" Applied Physics Letter, vol. 77, No. 19 (2000), pp. 3015-3017.

Yihua Zhu, Chunzhong Li, Qiufang Wu, "The process of coating on ultrafine particles by surface hydrolysis reaction in a fluidized bed reactor", Surface and Coatings Technology 135 (2000) 14-17.

Guo-Dong Zhan, Joshua D. Kuntz, Julin Wan and Amiya K. Mukherjee, "Single-wall carbon nanotubes as attractive toughening agents in alumina-based nanocomposites" Nature Materials, vol. 2., Jan. 2003. 38-42.

Y. Zhang, Nathan W. Franklin, Robert J. Chen, Hongjie Dai, "Metal Coating on Suspended Carbon Nanotubes and its Implication to Metal—Tube Interaction", Chemical Physics Letters 331 (2000) 35-41.

* cited by examiner

METHOD OF FRACING A WELLBORE

CROSS REFERENCE TO RELATED APPLICATION

This application is a divisional application of U.S. patent application Ser. No. 13/047,388, filed Mar. 14, 2011, the entire contents of which are incorporated herein by reference.

BACKGROUND

Tubular systems often employ increases in pressure within a tubular to cause actuation of a valve. Timing of actuation of a valve in such systems depends upon pressure achieving a threshold value needed to cause the particular actuation at the appropriate time. Making the adjustment in pressure at the appropriate time works well for such systems. However, systems and methods that allow timing of actuations to be automatic, for example, without requiring adjusting pressures at a specific time, are always of interest to those in the art.

BRIEF DESCRIPTION

Disclosed herein is a valving system, which includes a tubular, and a sleeve slidably engaged with the tubular having a seat thereon. The sleeve is configured to occlude flow from an inside of the tubular to an outside of the tubular when in a first position, allow flow between an inside of the tubular and an outside of the tubular at a first location upstream of the seat and a second location downstream of the seat when in a second position, and allow flow between an inside of the tubular and an outside at the tubular at the first location and not the second location when in a third position. The valving system also includes a disappearing member in operable communication with the tubular and the sleeve configured to prevent movement of the sleeve to the third position until disappearance thereof.

Also disclosed is a method of fracing a wellbore, which includes sealing a tubular within a wellbore at two locations defining an annular space thereby, opening at least two ports providing fluidic communication between an inside of the tubular and the annular space, flowing fluid from inside the tubular to the annular space through a first of the at least two ports, flowing fluid from the annular space to inside of the tubular through a second of the at least two ports, closing the second of the at least two ports, and pressuring the annular space through the first of the at least two ports.

Further disclosed is a method of adjusting a valve including moving a first member relative to a second member defining a first movement, exposing a disappearing member to a disappearing-inducing environment with the first movement, preventing further movement of the first member relative to the second member with the disappearing member, disappearing the disappearing member through exposure of the disappearing member to the disappearing-inducing environment; and moving the first member relative to the second member defining a second movement in response to disappearance of the disappearing member.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
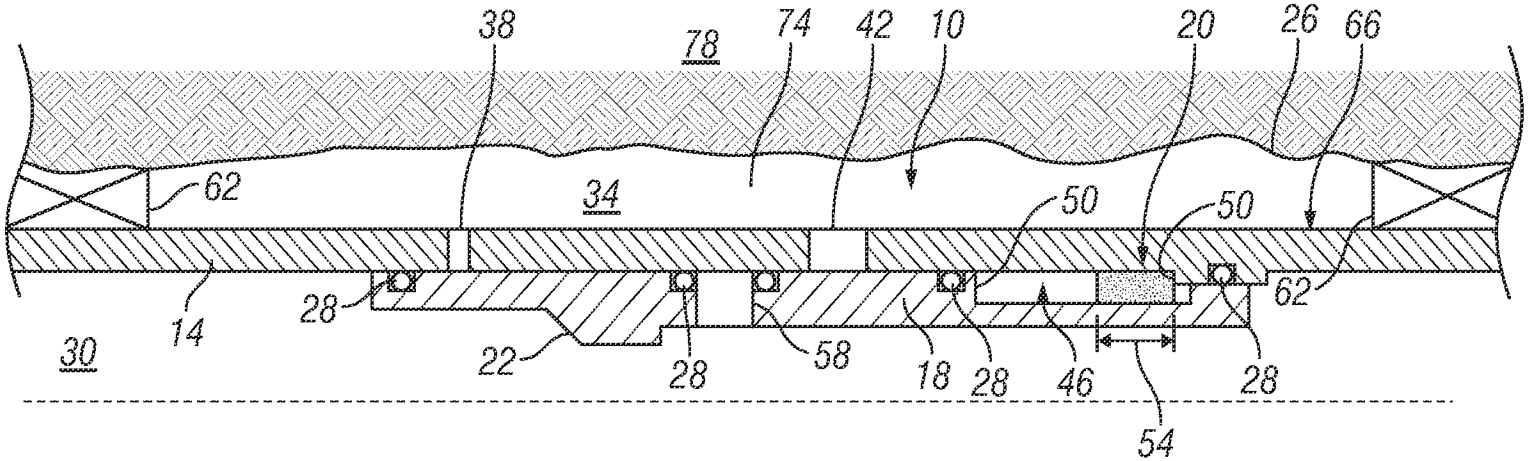
FIG. 1 depicts a partial cross sectional view of a valving system disclosed herein in a first position.
Figure 2:
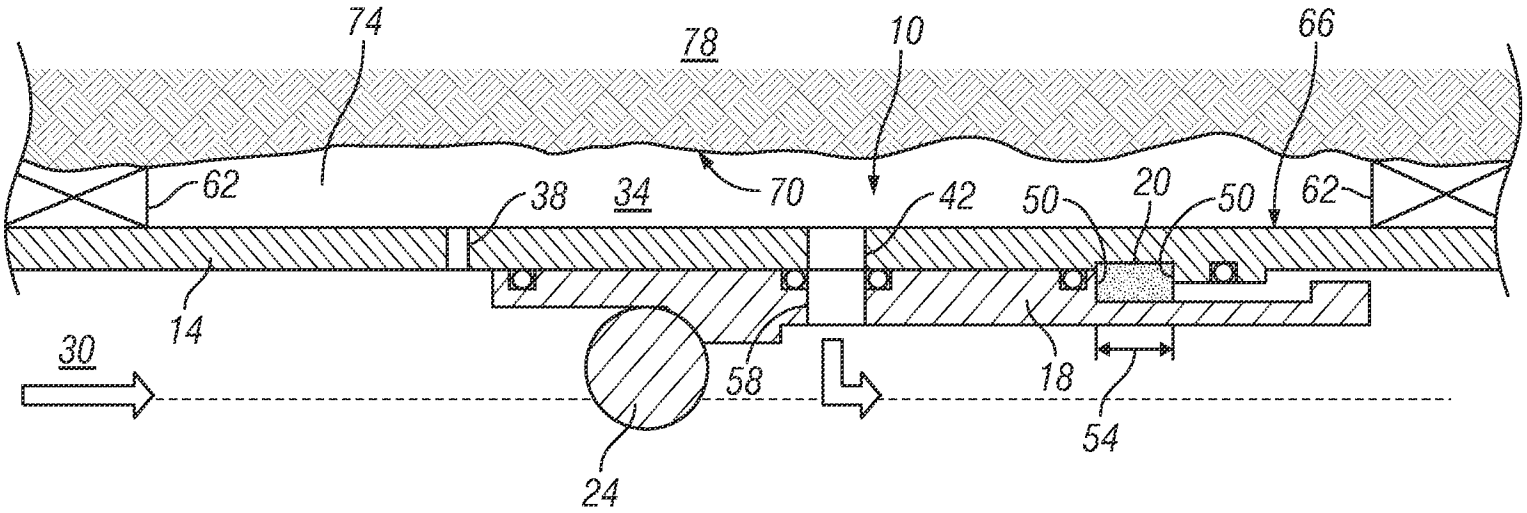
FIG. 2 depicts a partial cross sectional view of the valving system of FIG. 1 in a second position.
Figure 3:
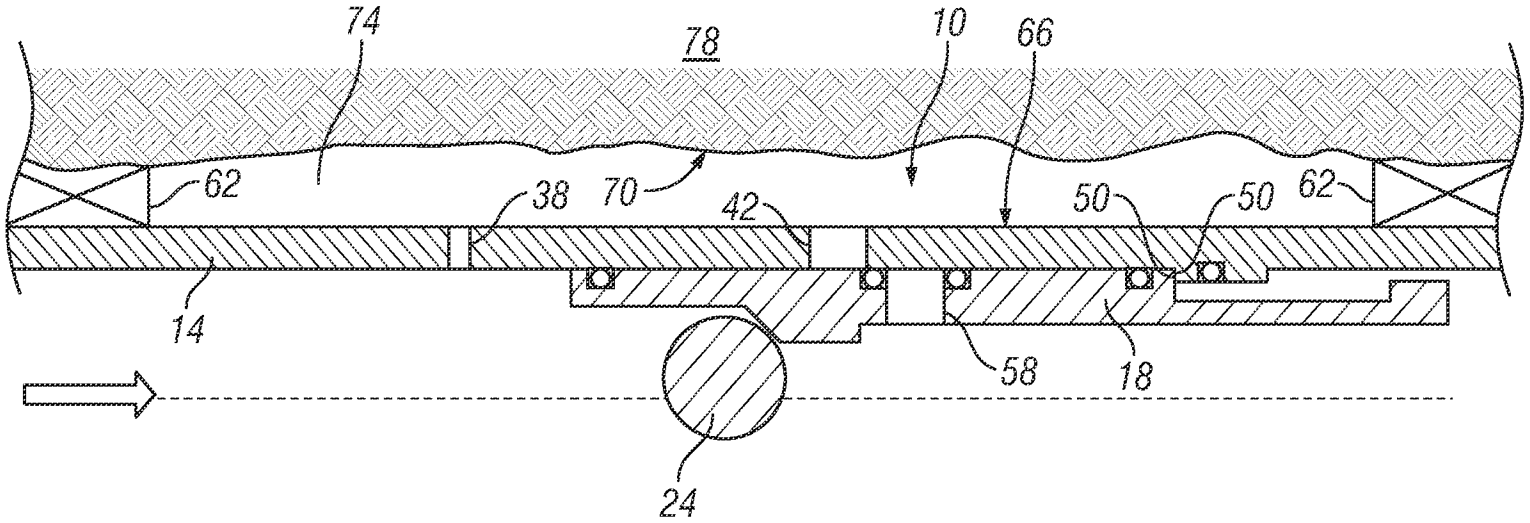
FIG. 3 depicts a partial cross sectional view of the valving system of FIG. 1 in a third position.

Referring to FIGS. 1-3, an embodiment of a valving system disclosed herein is illustrated at 10. The valving system 10 includes, a tubular 14, a sleeve 18 slidably sealably engaged with the tubular 14 having a plug seat 22, and a disappearing member 20. The seat 22 is pluggable by plugs 24, such as balls as shown herein, that have been pumped or dropped in a rightward direction in the figures, which may be in a downhole direction if the system 10 is employed in a wellbore 26, for example. The sleeve 18 is movable relative to the tubular 14 between at least a first position (shown in FIG. 1), a second position (shown in FIG. 2), and a third position (shown in FIG. 3), in response to pressure built against one of the plugs 24 sealed at the seat 22. Seals 28, illustrated herein as o-rings, sealably engagable with both the sleeve 18 and the tubular 14 allow the sleeve 18 to occlude flow between an inside 30 of the tubular 14 and an outside 34 of the tubular 14 when in a first position. At least one first port 38 and at least one second port 42, with one of each being illustrated, provide fluidic communication between the inside 30 and the outside 34 when the sleeve 18 is in the second position. In this position the first port 38 is located upstream of the plug seat (based on a direction o flow that causes plugs 24 to engage the seat 22), while the second port 42 is located downstream of the plug seat 24. The first port 38 remains open to fluidic communication between the inside 30 and the outside 34 when in the third position, while the second port 42 is occluded.

The disappearing member 20 is positioned within a chamber 46 defined between the tubular 14 and the sleeve 18. The chamber 46 is sealed from a disappearing-inducing environment, such as fluid, for example, from the inside 30 and the outside 34 when the sleeve 18 is in the first position. Conversely, the chamber 46 is open to fluid from the inside 30 when the sleeve 18 is in the second position. Since the disappearing member 20 is made of material that disappears in fluid, movement of the sleeve 18 from the first position to the second position initiates disappearance thereof. Additionally, the disappearing member 20 is positioned so that it is compressed between shoulders 50 on the tubular 14 and the sleeve 18 when the sleeve 18 is being urged in a downstream direction. A longitudinal dimension 54 of the disappearing member 20 is selected to assure that an opening 58 in the sleeve 18 is longitudinally aligned with the second port 42 when the disappearing member 20 is compressed between the shoulders 50. In fact, it is precisely the disappearing member 20 being compressed between the shoulders 50 that defines the second position of the sleeve 18 in relation to the tubular 14. The disappearing member 20 prevents the sleeve 18 from moving to the third position until sufficient disappearance thereof has occurred to allow the shoulders 50 to move closer together, and finally to make contact, thereby defining the third position.

When employed in a downhole fracing operation the valving system 10 can be positioned within the wellbore 26. Seals 62, shown herein as packers, sealingly engage both an outer surface 66 of the tubular 14 and walls 70 of the wellbore 26 at locations uphole of and downhole of the system 10, thereby isolating an annular space 74 therebetween. In this illustrated embodiment the tubular 14 is a portion of a production string, and an operator can run a plug 24 within the tubular 14 and seatingly engage it at the plug seat 22. Pressuring up against the seated plug 24 can cause the sleeve 18 to move from the first position to the second position. Fluid, being pumped against the seated plug 24, is able to flow out through the first port 38 and impinge on the walls 70 of the wellbore 26 thereby cutting holes into formation 78. This pumped fluid is able to flow back into the tubular 14 through the second port 42 below the seated plug 24. This arrangement allows fluid to continue flowing and cutting the formation 78 by providing a passageway for the fluid to flow (back through the second port 42) in cases where the formation 78 is not sufficiently permeable to allow the fluid flowing and cutting to flow thereinto.

As discussed above the movement of the sleeve 18 from the first to the second position has opened the chamber 46 to fluids on the inside 30. This includes wellbore fluids that are able to flow from the outside 34 to the inside through the second port 42. This fluid exposure initiates disappearance of the disappearing member 20. Knowing the rate of disappearance in the fluid allows an operator to establish a time period before the sleeve 18 is moved from the second position to the third position and concurrent closing of the second port 42. An operator can thereby set a "hole cutting time," through selection of the material for the disappearing member 20. This can be beneficial since it allows the operator to set the actual "hole cutting time" to match the desired "hole cutting time" determined based on knowledge of the formation. Disappearance of the disappearing member 20 can be through mechanisms such as, corrosion, disintegration or dissolution, for example.

Once the sleeve 18 has moved to the third position and the second port 42 has been closed the annular space 74 can be pressured up through the still opened first port 38 and fracing of the formation 78 can take place.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

The invention claimed is:

1. A method of fracing a wellbore, comprising:

sealing a tubular within a wellbore at two locations and defining an annular space between the tubular, the wellbore and two seals;

opening at least two ports providing fluidic communication between an inside of the tubular and the annular space;

flowing fluid from inside the tubular to the annular space through a first of the at least two ports;

flowing fluid from the annular space to inside of the tubular through a second of the at least two ports during times that both of the at least two ports are open and fluid is flowing from inside the tubular to the annular space through the first of the at least two ports;

closing the second of the at least two ports; and pressuring the annular space through the first of the at least two ports.

2. The method of fracing a wellbore of claim 1, wherein the opening the at least two ports includes moving a sleeve relative to the tubular.

3. The method of fracing a wellbore of claim 2, wherein the moving the sleeve includes pressuring up against a plug sealingly engaged with the sleeve.

4. The method of fracing a wellbore of claim 2, wherein the closing the second of the at least two ports includes moving the sleeve relative to the tubular.

5. The method of fracing a wellbore of claim 4, wherein the closing is delayed until a disappearing member in operable communication with the tubular and the sleeve has disappeared.

6. The method of fracing a wellbore of claim 5, wherein initiation of disappearing of the disappearing member occurs with the opening of the at least two ports.

7. The method of fracing a wellbore of claim 6, wherein the initiation of disappearing the disappearing member is through exposing the disappearing member to wellbore fluids.

8. The method of fracing a wellbore of claim 1, further comprising cutting a formation with the flowing of fluid from inside the tubular to the annular space.

9. A method of fracing a wellbore, comprising:

sealing a tubular within a wellbore at two locations and defining an annular space between the tubular, the wellbore and two seals;

opening at least two ports providing fluidic communication between an inside of the tubular and the annular space via moving a sleeve relative to the tubular;

flowing fluid from inside the tubular to the annular space through a first of the at least two ports;

flowing fluid from the annular space to inside of the tubular through a second of the at least two ports;

closing the second of the at least two ports via moving the sleeve relative to the tubular;

delaying the closing of the second of the at least two ports until a disappearing member in operable communication with the tubular and the sleeve has disappeared; and pressuring the annular space through the first of the at least two ports.

10. The method of fracing a wellbore of claim 9, wherein initiation of disappearing of the disappearing member occurs with the opening of the at least two ports.

11. The method of fracing a wellbore of claim 10, wherein the initiation of disappearing the disappearing member is through exposing the disappearing member to wellbore fluids.

* * * * *